US006006863A

United States Patent [19]

LeGrand et al.

[11] Patent Number: 6,006,863

[45] Date of Patent: Dec. 28, 1999

[54] LADDER LEG PROTECTION

[76] Inventors: Pamela LeGrand, 6520 Walnut Valley La., High Ridge, Mo. 63049; Marlene Hoenemeyer, 4085 Whitehall Dr., Arnold, Mo. 63010

[21] Appl. No.: 09/340,329

[22] Filed: Jun. 28, 1999

[51] Int. Cl.[6] ..... E06C 7/00

[52] U.S. Cl. ..... 182/129; 248/345.1

[58] Field of Search ..... 182/129; 248/345.1

[56] References Cited

U.S. PATENT DOCUMENTS

| | | | |
|---|---|---|---|
| 2,518,107 | 8/1950 | Wilson | 182/129 |
| 5,673,768 | 10/1997 | Schmitt | 182/129 |
| 5,692,581 | 12/1997 | Nelson | 182/129 |

*Primary Examiner*—Alvin Chin-Shue

[57] ABSTRACT

A ladder manufactured with steps that contain a foam rubber cushioning. The hard ladder step is notched out at a one inch depth at the front edge to insert and permanently glue the one and one half inch wide foam rubber cushion, covered in a waterproof fabric, and extending the foam rubber cushion out one half (½) inch further than the front edge of the hard step. The cushioned steps are then attached to the ladder frame. The ladder step cushioned with the foam rubber provides a soft edge to lean ones legs against while using the ladder. The foam rubber cushioned step can be built into any style ladder and ladders made of various materials.

The use of a ladder manufactured with this cushioned step would help protect him or her from pain or injury caused from leaning their legs against a ladder step made of a hard substance.

1 Claim, 1 Drawing Sheet

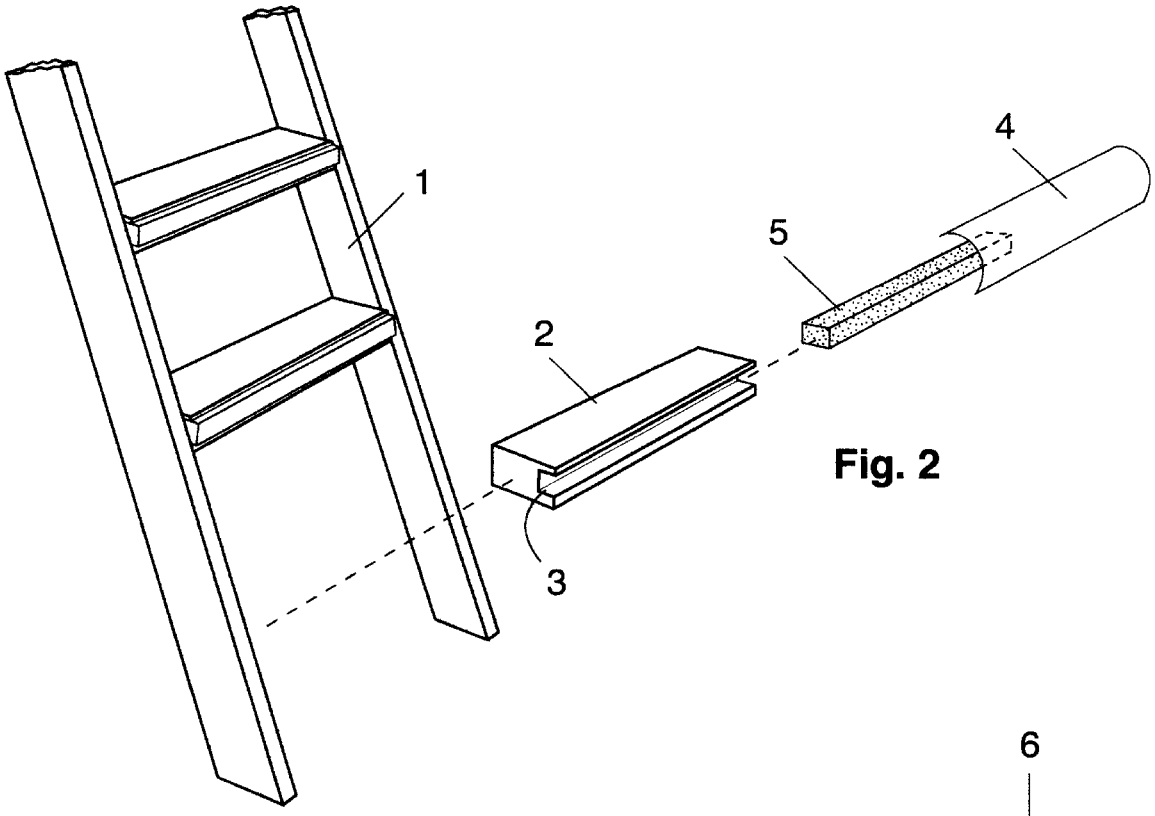
Fig. 1
Fig. 2
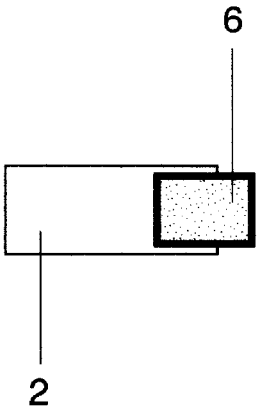
Fig. 3

LADDER LEG PROTECTION

CROSS REFERENCE TO RELATED APPLICATIONS

Not applicable.

STATEMENT REGARDING FEDERALLY SPONSORED RESEARCH AND DEVELOPMENT

Not applicable.

BACKGROUND

1. Field of Invention

This invention relates to manufacturing ladders with a cushioning material built into the steps to protect the users legs from pain and injury while leaning against the ladder steps.

2. Description of Prior Art

The use of ladders and ladder accessories of a wide variety of designs is known in prior art. The prior art discloses a large number of ladders and accessories. By way of example, U.S. Pat. No. 5,577,574 to Joseph discloses an adjustable stepladder, which could have padded steps to stand on. U.S. Pat. No. 2,518,107 to Wilson discloses a portable shin shield for temporary attachment to existing stepladders, unlike this invention, a non-removable cushion built directly into newly manufactured ladder steps.

In this respect, other ladders and accessories depart from the present invention substantially. Therefore, it can be appreciated that there exists a need for the present invention of new ladders to be built with cushioned step edges to protect the legs while leaning against the steps when using a ladder.

SUMMARY

In accordance with the present invention the ladder leg protection would protect the legs while leaning against a ladder step. The hard steps of newly manufactured ladders would contain an elongated soft foam rubber piece, one and one half inches wide, covered with a weatherproof fabric and cut to the size of the ladder step. The fabric covered foam rubber is then inserted one inch into a one inch deep notched out portion of the front of the hard step. The one and one half inch wide elongated foam rubber piece would extend out from the front edge of the hard step one half (½) inch to provide the cushion when leaning on the step.

OBJECTS AND ADVANTAGES

Accordingly, several objects and advantages of the present invention are:

a) to provide ladders with a built in cushion in the steps by inserting a soft foam rubber piece, covered with a weatherproof fabric, into the hard step edge to protect ones legs while leaning on the ladder and still providing a hard stable step for ascending and descending.

b) to provide a ladder with a cushioned step edge that ensures a reliable fit so the basic structure of the ladder is not changed and harm is not caused to the user.

c) to provide ladder steps with a cushioned edge that will withstand heavy use and weather when left outdoors.

DRAWING FIGURES

FIG. 1 is a view of a ladder with the ladder leg protection built into the hard steps replacing three of the standard hard steps currently in use.

FIG. 2 shows the materials necessary to build the ladder leg protection before assembling onto the ladder frame.

FIG. 3 is a side view of the ladder leg protection step showing the one and one half-inch wide, fabric covered foam rubber cushion, inserted one inch into the hard step and extending one half (½) inch out from the front of the hard step surface.

REFERENCE NUMERALS IN DRAWINGS

| | |
|---|---|
| 1 Ladder with cushioned step edge | 4 Weatherproof fabric |
| 2 Hard step | 5 Elongated foam rubber |
| 3 Notched out opening | 6 Fabric covered foam rubber |

DESCRIPTION—FIGS. 1–3 Embodiment

The invention illustrated in FIG. 1 is showing the finished ladder 1 manufactured with the weatherproof fabric covered foam rubber cushioned edge built into the steps.

FIG. 2 demonstrates the structuring of the ladder leg protection. The elongated foam rubber 5, cut one and one half inches wide, is covered with a weatherproof fabric 4 then glued into the notched out opening 3 being one inch in depth and cut the length of the step, in the front section of the hard step 2. The notched out opening 3 enables permanent attachment of the fabric covered foam rubber 6 into the hard step 2 to be assembled to the ladder frame providing the cushion for leaning against the step.

FIG. 3 is a side view of the hard step 2 showing the fabric covered foam rubber 6, cut one and one half inches wide, is one inch inside the hard step 2 and extended one half (½) inch beyond the front of the hard step 2 edge.

Various changes could be made in the above constructions without departing from the scope of the invention. It is intended that all matter contained in the above description or shown in the accompanying drawing shall be interpreted as illustrative and not in a limiting sense.

Operation—FIGS. 1–3

The invention is illustrated by showing a ladder 1 manufactured with a hard material and having the step edges made with a soft material. The one and one half inch wide elongated foam rubber 5 is covered with a weatherproof fabric 4, inserted and permanently glued into the one inch deep notched out opening 3 inside the hard step 2 extending one half (½) inch beyond the front of the hard step 2 edge to provide the leg protection. When manufacturing ladders the ladder leg protection would replace the existing hard steps on any or all of the required steps per ladder.

Advantages

From the description above some advantages become evident:

a) The ladder leg protection can be built into ladder steps made from commonly known ladder materials such as; wood, aluminum, and fiberglass.

b) The ladder leg protection cushion can be manufactured in various materials, shapes, colors, and sizes to fit into the steps of different ladder styles.

Conclusion, Ramification, and Scope

In conclusion, the reader will see the value of the ladder leg protection. Ladders are used often by businesses and individuals. Complaints of pain and injury to the legs are common with ladder use. Furthermore, the ladder leg protection has the additional advantages in that it can provide protection to the legs with a low cost addition to new ladders;

it will not change the basic structure of current ladders;

it is adaptable to any size or style ladder.

Although the description above contains many specifications, these should not be construed as limiting the scope of the invention but as merely providing illustrations of some of the preferred embodiments. Minor changes to the material, shape, size and color may be practiced without departure from the invention.

Thus the appended claims and their legal equivalents should determine the scope of the invention, rather than the examples given.

We claim:

1. A new method of manufacturing ladders by building a soft cushion into the front edge of hard ladder steps to allow the user of the ladder to lean against the steps without causing pain or injury to the legs comprising:

a) an elongated soft substance the length of a ladder step, covered in a weatherproof fabric, to be permanently built into the front edge of a hard ladder step, extending out of the hard step to provide a cushion when leaning against the step further comprising the cushioned steps are permanently attached to the ladder frame during the manufacturing of new ladders.

* * * * *